United States Patent [19]

Wallis

[11] Patent Number: 4,774,865

[45] Date of Patent: Oct. 4, 1988

[54] DIE STAMPING SYSTEM

[76] Inventor: Bernard J. Wallis, 2215 Dacosta, Dearborn, Mich. 48128

[21] Appl. No.: 99,914

[22] Filed: Sep. 22, 1987

[51] Int. Cl.[4] ..... B21D 45/02

[52] U.S. Cl. ..... 83/128; 72/344; 72/427; 72/453.13; 83/123; 267/119

[58] Field of Search ..... 83/123, 125, 128, 129, 83/130, 131; 72/344, 345, 427, 453, 13; 267/119

[56] References Cited

U.S. PATENT DOCUMENTS

| | | | |
|---|---|---|---|
| 3,440,909 | 4/1969 | Schmid et al. | 83/123 X |
| 3,570,343 | 3/1971 | Wolnosky et al. | 83/124 |
| 3,739,669 | 6/1973 | Seki | 83/123 |
| 4,583,722 | 4/1986 | Wallis | 267/119 |
| 4,586,360 | 5/1986 | Jürgensmeyer et al. | 72/344 X |

*Primary Examiner*—Frank T. Yost

*Attorney, Agent, or Firm*—Barnes, Kisselle, Raisch, Choate, Whittemore & Hulbert

[57] ABSTRACT

A die stamping system for use in a fine blanking apparatus that includes opposed die members which clamp a metal workpiece to be cut and pierced after which the die members are moved away from one another and the slugs pierced from the blank and the cut blanks are subsequently ejected wherein the ejector is controlled for a selected delay time by a plurality of cylinder assemblies mounted in a manifold so that they are connected to a source of inert gas such as nitrogen under high pressure. Each cylinder assembly includes a first piston associated with and exposed to the nitrogen in the manifold and a second piston engaged by the first piston and urged outwardly into engagement with a punch base. A hydraulic circuit is associated with the second piston and controlled by a valve such that upon downward movement of the first piston hydraulic fluid may flow freely without inhibiting the movement of the first piston, but upon actuation of the valve, hydraulic fluid locks the first piston and thereby prevents it from moving upwardly until the valve is actuated so that a predetermined time delay is provided.

8 Claims, 2 Drawing Sheets

DIE STAMPING SYSTEM

This invention relates to fine blanking and particularly to a fine blanking system that incorporates predetermined time delay or ejection of the part that is formed and the slug that is pierced therefrom.

BACKGROUND AND SUMMARY OF THE INVENTION

In a typical fine blanking apparatus, it is desired to accurately cut and punch a part. Such apparatus usually comprises an upper die and a lower die with one or more punches associated with the upper die and a punch base associated with the lower die, and movable with respect to the lower die. In the forming of parts in order to insure the desired precision, it has been common to provide a delay in the movement of the punch base upwardly after the part has been cut and punched from the workpiece. Such a time delay has been produced by cam control of the punch bases or by a hydraulic system associated with the punch bases. A typical example of a hydraulic system is shown in U.S. Pat. No. 3,570,343.

Such hydraulic systems have a disadvantage in that they require associated hydraulic fluid lines, valves and the like externally of the hydraulic cushion on the press.

Among the objectives of the present invention are to provide a die stamping system which can be provided within the confines of conventional apparatus and is especially applicable for fine stamping; which will provide the desired time delay; wherein the time delay can be readily adjusted as desired without disassembling the system and wherein the delay action is positive.

In accordance with the invention, each cylinder assembly includes a first piston associated with and exposed to the inert gas such as nitrogen in the manifold and a second piston engaged by the first piston and urged outwardly into engagement with a punch base. A hydraulic circuit is associated with the second piston and controlled by a valve such that upon downward movement of the first piston hydraulic fluid may flow freely without inhibiting the movement of the first piston, but upon actuation of the valve hydraulic fluid locks the first piston and thereby prevents it from moving upwardly until the valve is actuated so that a predetermined time delay is provided.

DESCRIPTION OF THE DRAWINGS

FIG. 4 is a vertical sectional view of a modified form of a cylinder.

FIG. 5 is a plan view of the cylinder shown in FIG. 4.

DESCRIPTION

Figure 1:
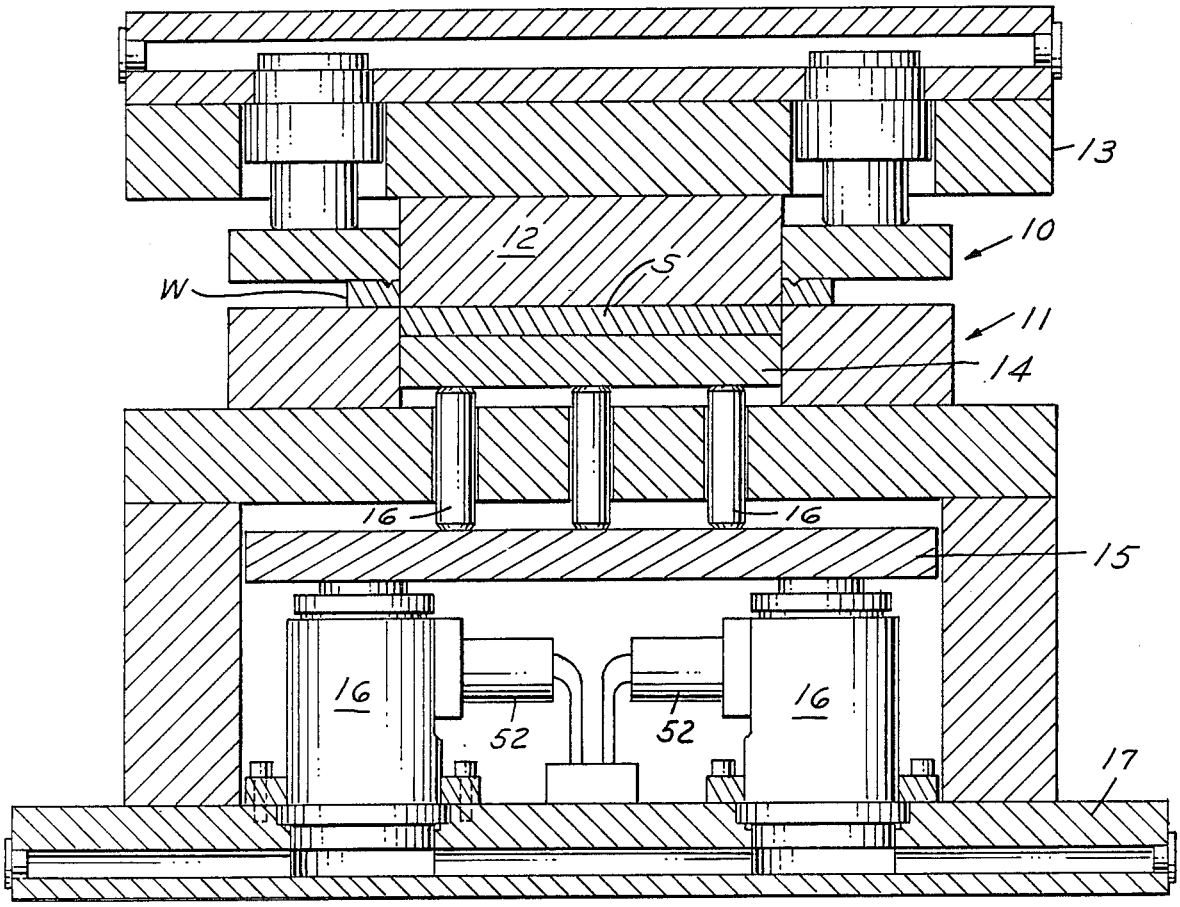
FIG. 1 is a sectional view of a fine blanking apparatus embodying the invention.
Figure 2:
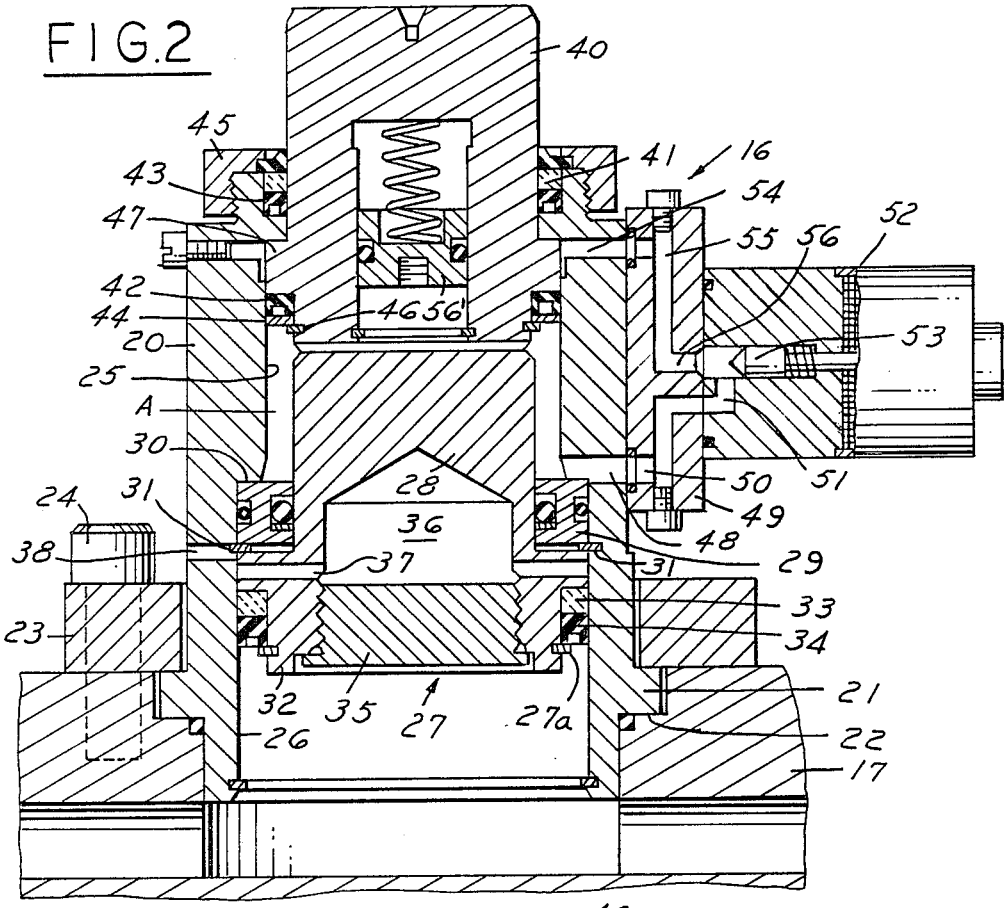
FIG. 2 is a vertical sectional view of a cylinder utilized in the apparatus.
Figure 3:
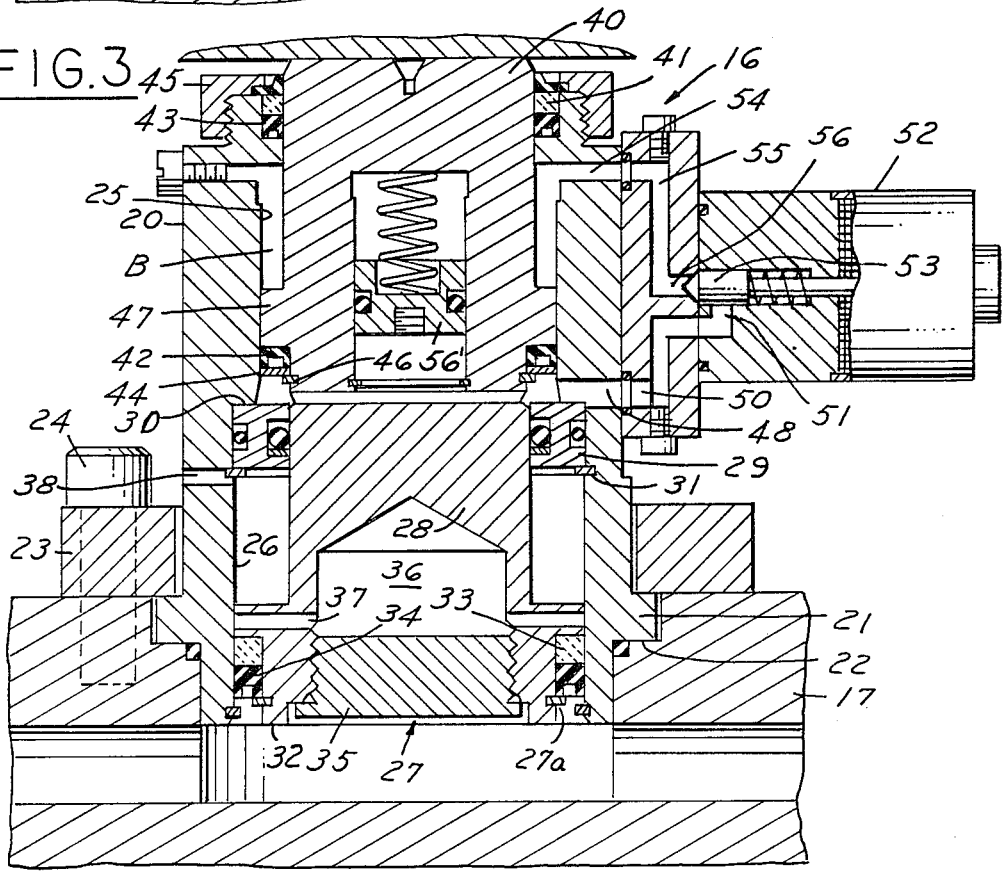
FIG. 3 is a view similar to FIG. 2 showing the parts in a different operative position.

Referring to FIGS. 1–3, the die stamping system which is particularly useful in fine blanking and embodying the invention is intended to be used with a die stamping apparatus in a press wherein an upper die assembly 10 is provided on the upper portion of the press and a lower die assembly 11 is provided on the lower portion of the press. The upper die 10 includes an upper punch 12 that is movable by a die cushion 13 downwardly as viewed in FIG. 1 to punch a slug S from a workpiece W. The lower die 11 includes a lower pad 14 associated with the punch 12 and movable downwardly within the die. A punch base 15 is supported by a plurality of cylinder assemblies 16 as presently described. The cylinder assemblies 16 are mounted on a manifold 17 which is supplied with inert gas such as nitrogen under a predetermined high pressure. The pressure of the inert gas may vary between about 500 and 2000 PSI.

Each cylinder assembly 16 is provided with hydraulic time delay means mounted thereon such that the upward movement of the punch plate 15 is delayed when the die is opened thereby insuring that the ejection of the slug S will not interfere with the precise and accurate hole that has been cut in the workpiece W.

As shown in FIG. 2, each cylinder assembly 16 includes a cylinder body 20 that has open upper and lower ends. The cylinder body 20 is provided with a flange 21 that engages a shoulder 22 in the manifold 17 and a clamp ring 23 retains the cylinder in position through bolts 24.

The cylindrical body 20 includes an upper cylindrical opening 25 having a lesser diameter than a lower cylindrical portion 26. A piston assembly 27 is positioned in the lower portion 26 and includes an upper portion 28 of reduced diameter which projects upwardly. A sealing ring 29 engages a flange 30 in body 20 and provides a seal, the ring 29 being retained by snap ring 31. The piston 27 includes a lower portion 32 that includes a bearing 33 and a seal 34 retained on piston 27 by a snap ring **27*a* to engage the cylindrical portion 26. A body 35 is threaded into the lower hollow portion of the piston 27 to form a chamber 36. Chamber 36 is capable of being vented to the atmosphere by radial passages 37 in the piston 27 when passages 37 become aligned with a radial passage 38 in the wall 20**.

By this arrangement, the piston 27 of each cylinder assembly 16 is yieldingly urged upwardly by the pressure of the nitrogen in the manifold. Such cylinders are more specifically shown, for example in U.S. Pat. Nos. 4,342,448, 4,572,489 and 4,583,722.

Each cylinder assembly 16 further includes an upper piston 40 that is associated with the upper cylindrical portion 25 and is engaged by the lower piston 27 due to the pressure of the inert gas to urge it upwardly into the position shown in FIG. 2. Upper and lower bearings 41, 42 and seals 43, 44, respectively, are provided for the upper piston 40. A upper bearing 43 is supported on the cylinder body 20 in a shoulder and is held in position by a threaded ring 45. The lower bearing 42 and seal 44 are interposed between a snap ring 46 and a radial flange 47 that extends from the piston 40 so that the lower bearing 42 and seal 44 move with the piston 40. The piston 40 when in its upper position defines an annular fluid space A below flange 47 that communicates through a radial passage 48 in the wall of cylinder body 20 to a hydraulic manifold 49 which, in turn, has communicating passages 50, 51 extending to a solenoid operated valve 52 that includes a plunger 53 that is normally open. When in the lower position such as FIG. 3, the piston 40 defines an annular chamber B above flange 47 that communicates through a radial passage 54 in the wall of the cylinder body 20 and passage 55 in the manifold 49 to a passage 56 in the solenoid valve 52. When the solenoid valve is in the normally open position, fluid flows freely between chambers A and B (FIG. 2). A spring loaded piston 56' in piston 40 applies pressure to the hydraulic fluid in the passages and chambers.

During the downward movement of the upper die, the two pistons 27, 40 under the action of the compressed nitrogen serve to form a cushion and the pistons 27, 40 move in unison. When the fine blanking operation is completed and the upper die is moved upwardly, the solenoid valve 52 can be energized to cause the plunger to close communnication between the passages 48, 50, 51 on the one hand and the passages 54, 55, 56 on the other so that the hydraulic fluid cannot flow and the upper piston 40 is locked in a lower position against movement as shown in FIG. 3. When valve 52 is de-energized, the fluid can then flow freely permitting the piston to move upwardly under the action of the lower piston 27 and thereby eject the slug S that has been cut or punched from the workpiece.

It can be seen that the length of time delay and the place or position of the piston 40 can be controlled by the duration and timing of energization of the valve 52.

In the form shown in FIGS. 4 and 5, the corresponding parts have similar structures and functions except that the solenoid valve **52*a* is oriented vertically thereby providing a smaller lateral envelope. Corresponding numerals are provided with modified passages having the suffix a. Such an arrangement has the advantage of permitting use of the system in association with small dies and manifolds since the valve 52*a* does not project radially outwardly as much as in the case of forms shown in FIGS. 1–3**.

It can thus be seen that there has been provided a die stamping system which can be provided within the confines of conventional apparatus and is especially applicable for fine stamping; which will provide the desired time delay; wherein the time delay can be readily adjusted as desired without disassembling the system and wherein the delay action is positive.

I claim:

1. In a die stamping system for use in a fine blanking apparatus and the like that includes opposed die members which clamp a metal workpiece to be cut and pierced after which the die members are moved away from one another and the slugs pierced from the blank and the cut blanks are sequentially ejected wherein the ejector is controlled for a selected delay time by a plurality of cylinder assemblies mounted in a manifold so that they are connected to a source of inert gas under high pressure the improvement wherein each cylinder assembly includes a first piston associated with and exposed to the nitrogen in the manifold, a second piston engaged by the first piston and urged outwardly into engagement with a punch base, and hydraulic time delay means mounted on said cylinder and associated with said first piston such that upon downward movement of the first piston, hydraulic fluid may flow freely without inhibiting the movement of the first piston, and upon actuation, hydraulic fluid locks the first piston against movement and thereby prevents it from moving upwardly until the means is actuated so that a predetermined time delay is provided.

2. The die stamping system set forth in claim 1 wherein said hydraulic time delay means comprises a hydraulic circuit associated with the second piston, and a valve, said valve being operable to permit hydraulic fluid to flow freely or to interrupt flow in said circuit and lock said first piston.

3. The die stamping system set forth in claim 2 wherein said hydraulic circuit includes a spring loaded plunger in said second piston applying pressure to the hydraulic fluid.

4. The die stamping system set forth in claim 1 comprising a single cylinder body having a first cylindrical opening associated with said first piston and a second cylindrical opening associated with said second piston, means between said cylinder body and said second piston defining spaced chambers, passage means between said chambers, said hydraulic time delay means controlling flow between said chambers.

5. The die stamping system set forth in claim 4 wherein said passage means are provided in part through said cylinder body.

6. The die stamping system set forth in claim 5 including a hydraulic manifold associated with said passages and said hydraulic time delay means.

7. The die stamping system forth in claim 6 wherein said hydraulic circuit includes a spring loaded plunger in said second piston applying pressure to the hydraulic fluid.

8. The die stamping system set forth in claim 1 wherein said time delay means includes a valve oriented vertically to minimize the lateral dimensions of the system.

* * * * *